US007607952B2

(12) United States Patent
Tai

(10) Patent No.: US 7,607,952 B2
(45) **Date of Patent: *Oct. 27, 2009**

(54) BATTERY CONTACT

(75) Inventor: Yung-Yu Tai, Taoyuan Hsien (TW)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/748,610

(22) Filed: May 15, 2007

(65) Prior Publication Data

US 2008/0286992 A1 Nov. 20, 2008

(51) Int. Cl.
*H01R 13/24* (2006.01)

(52) U.S. Cl. ..... 439/700

(58) Field of Classification Search ..... 439/700, 439/289, 824, 862, 500
See application file for complete search history.

(56) References Cited

U.S. PATENT DOCUMENTS

| | | | | | |
|---|---|---|---|---|---|
| 2,721,313 | A * | 10/1955 | English | 439/369 |
| 4,199,209 | A * | 4/1980 | Cherian et al. | 439/591 |
| 4,773,877 | A * | 9/1988 | Kruger et al. | 439/482 |
| 4,778,404 | A * | 10/1988 | Pass | 439/387 |
| 4,978,311 | A * | 12/1990 | Oda et al. | 439/188 |
| 5,167,512 | A * | 12/1992 | Walkup | 439/66 |
| 5,807,123 | A * | 9/1998 | Spiegelaar et al. | 439/188 |
| 6,059,595 | A * | 5/2000 | Lacrouts-Cazenave | 439/289 |
| 6,083,059 | A * | 7/2000 | Kuan | 439/862 |
| 6,099,356 | A * | 8/2000 | Hwang | 439/660 |
| 6,402,567 | B1 * | 6/2002 | Zhu | 439/700 |
| 6,491,527 | B1 * | 12/2002 | Smith | 439/66 |
| 6,572,386 | B1 | 6/2003 | Howell et al. | 439/66 |
| 6,783,405 | B1 * | 8/2004 | Yen | 439/824 |
| 6,890,191 | B1 * | 5/2005 | Thorburn | 439/98 |
| 6,945,827 | B2 * | 9/2005 | Grube et al. | 439/700 |
| 6,967,492 | B2 | 11/2005 | Tsui et al. | 324/754 |
| 6,974,332 | B2 * | 12/2005 | Ma | 439/66 |
| 7,153,173 | B2 * | 12/2006 | Harasawa et al. | 439/862 |
| D555,096 | S * | 11/2007 | Peng | D13/133 |
| 7,335,068 | B2 * | 2/2008 | Dwan et al. | 439/700 |

* cited by examiner

*Primary Examiner*—T C Patel
*Assistant Examiner*—Vladimir Imas
(74) *Attorney, Agent, or Firm*—Woodcock Washburn LLP

(57) ABSTRACT

A compressible electrical contact is disclosed. The compressible electrical contact may include a nose portion, a corrugated portion and a tail portion. The tail portion may extend from a first end of the corrugated portion and the nose portion may extend from an opposite end of the corrugated portion. The corrugated portion may define a first surface and a second surface opposite the first surface. The first and second surfaces may have a width. The corrugated portion may also have a third surface extending between the first and second surfaces and a fourth surface opposite the third surface. A plurality of corrugations may be formed in the third and fourth surfaces of the corrugated portion.

26 Claims, 7 Drawing Sheets

BATTERY CONTACT

CROSS-REFERENCE TO RELATED APPLICATIONS

The subject matter disclosed and claimed herein is related to the subject matter disclosed and claimed in U.S. patent application Ser. No. 11/748,596, filed May 15, 2007 now U.S. Pat. No. 7,527,532 which issued on May 5, 2009.

BACKGROUND

Compressible electrically conductive contacts are well known for use in applications such as for battery connectors in cell phones. Typically, such contacts are compressible upon insertion of the battery into a battery compartment, between the compressible contact on one end and a complementary, usually non-compressible, contact at the other end, thereby ensuring good electrical contact at both ends of the battery.

Such compressible electrical contacts may be stamped from a sheet of electrically conductive material. As stamped, the contacts may have a corrugated (or spring like) portion that may create a normal force on an end of the battery. Such corrugated portions, however, typically have a cross-sectional area that is equal to the width of the sheet from which the contacts are stamped. For this reason, the contacts may not be robust enough to handle sufficient current to continually operate the device reliably at full power. For example, cell phones may require about 2 to about 4 volts and about 100 to about 400 milliamps.

Additionally, because the battery may be repeatedly inserted and removed from the connector compartment, the contacts may tend to lose their ability to maintain sufficient normal force on the battery. That is, permanent set may occur in the contacts, thereby reducing the original normal force capabilities of the contacts. Accordingly, there is a need for a compression contact that is capable of lower contact resistance, while maintaining such normal forces on the batteries even after several uses.

SUMMARY

Disclosed herein are compression contacts that are capable of lower contact resistance and are better adapted to maintain normal forces on the batteries after several uses. Such a contact may be manufactured from a sheet of electrically conductive material. The contact may include a tail portion, a nose portion, and a corrugated portion. The corrugated portion defines a first surface, and a second surface opposite the first surface. The first and second surfaces may have a width that is defined by the thickness of the sheet from which the contact is stamped. The corrugated portion also defines a third surface extending between the first and second surfaces, and a fourth surface, opposite the third surface, also extending between the first and second surfaces. The contact may be folded along the third and fourth surfaces to form the corrugations. The tail portion may extend from a first end of the corrugated portion. The nose portion may extend from an opposite end of the corrugated portion. In such a compression contact, the corrugated portion may maintain at least a minimum normal force even after several uses, and may be capable of lower contact resistance.

Methods for making such compression contacts are also disclosed. The contacts may be stamped from a sheet of electrically conductive material. After a specifically shaped piece has been stamped, the corrugated portion may be formed. The corrugated portion may be folded along the third and fourth surfaces to form the corrugations. The tail portion may be formed near a first end of the corrugated portion and the nose portion may be formed near the opposite end of the corrugated portion.

DETAILED DESCRIPTION OF ILLUSTRATIVE EMBODIMENTS

Figure 1:
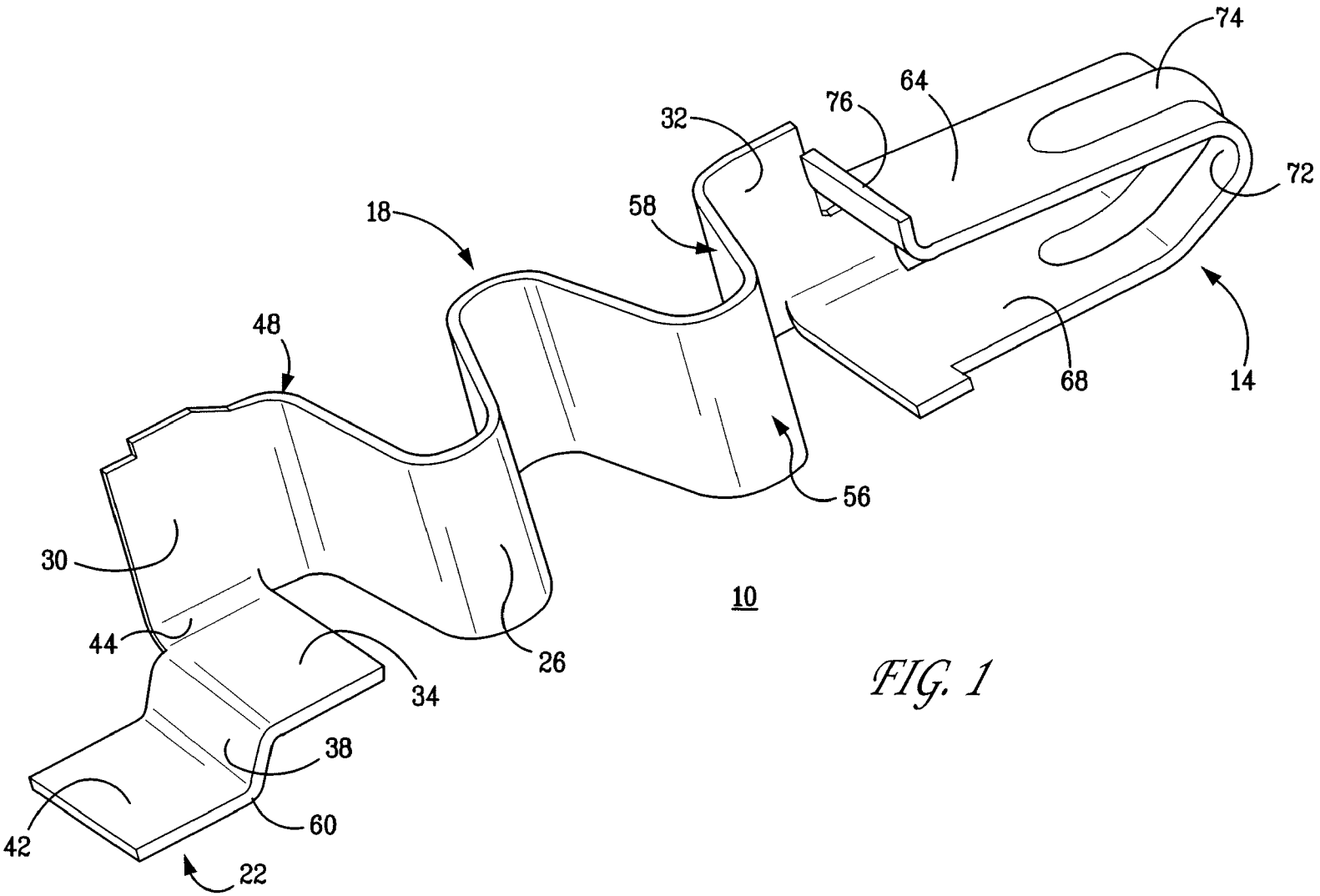
FIG. 1 is a perspective view of an example embodiment of a compressible electrical contact.

FIG. 1 depicts an example embodiment of a compressible electrical contact 10. The compressible contact 10 may be stamped and formed from a sheet of electrically-conductive material. As shown, the contact 10 may include a nose portion 14, a corrugated portion 18, and a tail portion 22. The corrugated portion 18 may be formed to have a plurality of corrugations 26. The tail portion 22 may be formed near a first end 30 of the corrugated portion 18 and the nose portion 14 may be formed near a second end 32 of the corrugated portion 18.

Figure 2:
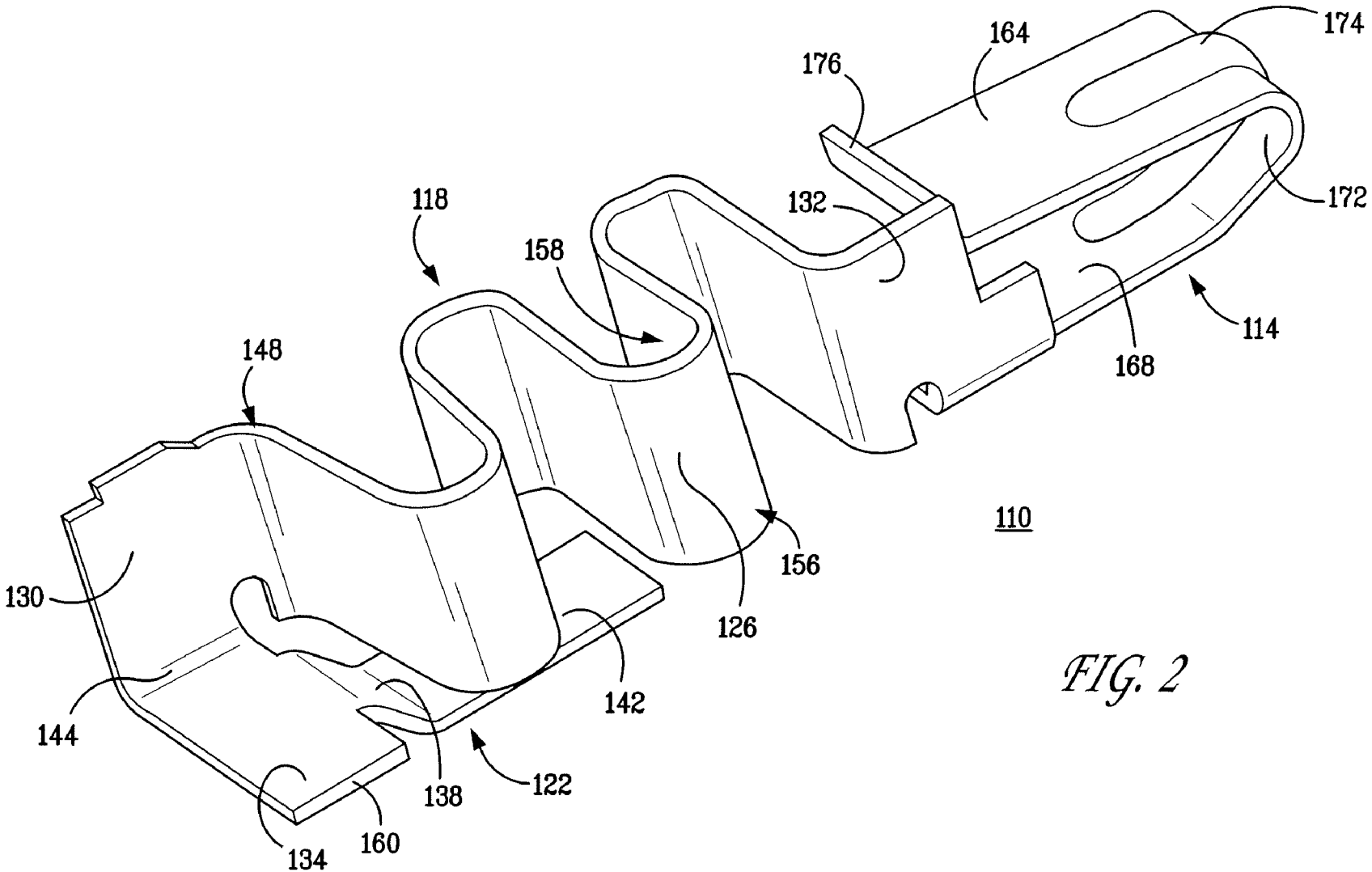
FIG. 2 is a perspective view of another example embodiment of a compressible electrical contact.

The tail portion 22 may include an upper portion 34, a transition portion 38, and a lower portion 42. The upper portion 34, transition portion 38, and lower portion 42 of the tail portion 22 may combine to create a mounting surface for the contact 10. The lower portion 42 of the tail portion 22 may extend away from the nose portion 14 as depicted in FIG. 1. The contact 10 shown in FIG. 1 depicts a left side 44 of the upper portion 34 of the tail portion 22 extending into the first end 30 of the corrugated portion 18. It should be understood that the tail portion 22, is not limited to the embodiment depicted in FIG. 1, and may include other designs, such as depicted in FIG. 2 for example.

The corrugated portion 18 may be designed to maintain a desirable normal force after several uses and may be capable of lower contact resistance. As depicted in FIG. 1, the corrugated portion 18 may include a first surface 48, a second surface (not seen in FIG. 1) opposite the first surface, a third surface 56, and a fourth surface 58 opposite the third surface. The corrugations 26 may be formed in the third and fourth surfaces 56, 58. By forming the corrugations 26 in the third and fourth surfaces, the corrugated portion of the contact 10 may have a greater cross-sectional area. For this reason, the contact 10 may have a higher normal force, and lower contact resistance.

As depicted, the corrugated portion 18 may be formed to be substantially perpendicular to the tail portion 22. That is, the first surface 48 of the corrugated portion 18 may define a plane that is perpendicular to a plane defined by a sidewall 60 of the tail portion 22. Both the first surface 48 of the corrugated portion 18, and the sidewall 60 of the tail portion 22 may be defined by the thickness of the sheet of electrically conductive material in which the contact 10 is stamped and formed from. The corrugated portion 18 is not limited to the depicted structure, however, and may include other orientations. For example, the corrugated portion 18 need not be perpendicular to the tail portion 22.

The nose portion 14 may be formed to have a C-shape and may be formed near the second end 32 of the corrugated portion 18, as depicted in FIG. 1. Preferably, the nose portion 14 is plated with a precious metal, such as gold, for example. In such an embodiment, the nose portion 14 may include an upper portion 64, a lower portion 68, and an end portion 72. A contact point 74 may also be formed in the nose portion 14, thereby providing optimal contact between the contact 10 and a battery terminal (not shown) of a battery. The upper portion 64 may include a lip 76 capable of holding the contact within a connector housing. The function of the lip 76 will be explained in connection with FIG. 5 below. It should be noted that the nose portion 14 is not limited to the structure depicted in the FIGs. For example, a longitudinal axis of the nose portion 14 is depicted as being centered with a longitudinal axis of the corrugated portion 18, however, the nose portion 14 is not limited to such an orientation. Accordingly, the longitudinal axis of the nose portion 14 may be offset from the longitudinal axis of the corrugated portion 18.

It should be understood that the contact 10 is not limited to the structures described and shown in FIG. 1. Accordingly, contact 10 may have other designs that enable the contact 10 to maintain a desirable normal force after several uses and allow the contact 10 to have a lower contact resistance.

FIG. 2 depicts another example embodiment of a compressible electrical contact 110. As shown, the contact 110 may include a nose portion 114, a corrugated portion 118, and a tail portion 122. The corrugated portion 118 may have a plurality of corrugations 126. As depicted, the contact 110 may have four corrugations 126.

As depicted, the tail portion 122 may be formed near a first end 130 of the corrugated portion 118 and may include an upper portion 134, a transition portion 138, and a lower portion 142. The upper portion 134, transition portion 138, and lower portion 142 of the tail portion 122 may combine to create a surface mount for the contact 110. The lower portion 142 of the tail portion 122 may extend toward the nose portion 114 as depicted in FIG. 2. The contact 110 shown in FIG. 2 depicts a left side 144 of the upper portion 134 of the tail portion 122 extending into the first end 130 of the corrugated portion 118. It should be understood that the tail portion 122, is not limited to the embodiment depicted in FIG. 2, and may include other designs, such as depicted in FIG. 1 for example.

The corrugated portion 118 may be designed to maintain a desirable normal force after several uses and may have a lower contact resistance. As depicted in FIG. 2, the corrugated portion 118 may include a first surface 148, a second surface (not seen in FIG. 2), a third surface 156, and a fourth surface 158 opposite the third surface. Each corrugation 126 is preferably formed in the third and fourth surfaces 156, 158. By forming the corrugations 126 in the third and fourth surfaces, the contact 110 may have a greater cross-sectional area. For this reason, the contact 110 may have a higher normal force, and lower contact resistance.

As depicted, the corrugated portion 118 may be formed to be substantially perpendicular to the tail portion 122. That is, the first surface 148 of the corrugated portion 118 may define a plane that is perpendicular to a plane defined by a sidewall 160 of the tail portion 122. Both the first surface 148 of the corrugated portion 118, and the sidewall 160 of the tail portion 122 may be defined by the thickness of the sheet of electrically conductive material in which the contact 110 is stamped and formed from. The corrugated portion 118 is not limited to the depicted structure, however, and may include other orientations. For example, the corrugated portion 118 does not have to be perpendicular to the tail portion 122.

The nose portion 114 may be formed to have a C-shape and may be formed near a second end 132 of the corrugated portion 118, as depicted in FIG. 2. Preferably, the nose portion 114 is plated with a precious metal, such as gold, for example. In such an embodiment, the nose portion 114 may include an upper portion 164, a lower portion 168, and an end portion 172. A contact point 174 may also be formed in the nose portion 114, thereby providing optimal contact between the contact 110 and a battery terminal (not shown) of a battery. The upper portion 164 may include a lip 176 capable of holding the contact within a connector housing. The function of the lip 176 will be explained in connection with FIG. 5 below. It should be noted that the nose portion 114 is not limited to the structure depicted in the FIGs. For example, a longitudinal axis of the nose portion 114 is depicted as being centered with a longitudinal axis of the corrugated portion 118, however, the nose portion 114 is not limited to such an orientation. Accordingly, the longitudinal axis of the nose portion 114 may be offset from the longitudinal axis of the corrugated portion 118.

The contact 110 is not limited to the structures described and shown in FIG. 2. Accordingly, contact 110 may have other designs that enable the contact 110 to maintain a desirable normal force after several uses and allow the contact 110 to possibly have a lower contact resistance.

Figure 3:
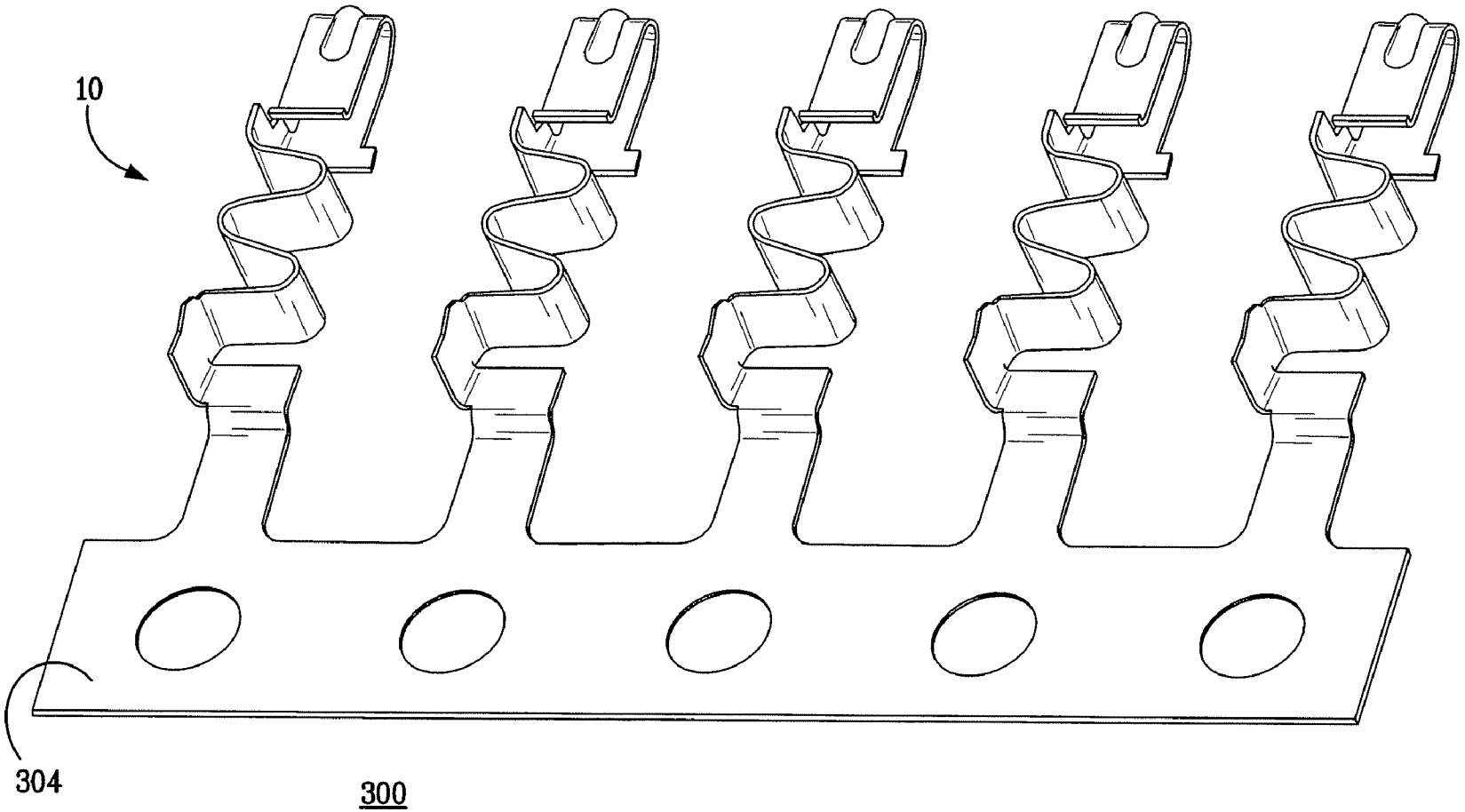
FIG. 3 is a perspective view of a plurality of compressible electrical contacts after stamping and forming.

The compressible electrical contacts may be stamped and formed from an electrically conductive sheet 300. FIG. 3 depicts several contacts 10 stamped and formed from the electrically conductive sheet 300. As shown the contacts may be connected to a carrier strip 304. The electrically conductive sheet 300 may be made from a conductive material such as a copper alloy for example. Preferably, the electrically conductive sheet 300 is made from beryllium copper.

FIGS. 4, 5, 6A, and 6B depict an example embodiment of a connector 306 having a plurality of compressible electrical contacts 310 contained therein. As shown, the compressible electrical contacts 310 may be disposed in apertures 312 defined by a connector housing 313. The connector housing 313 may be made from a dielectric material, such as a plastic, for example.

Figure 5:
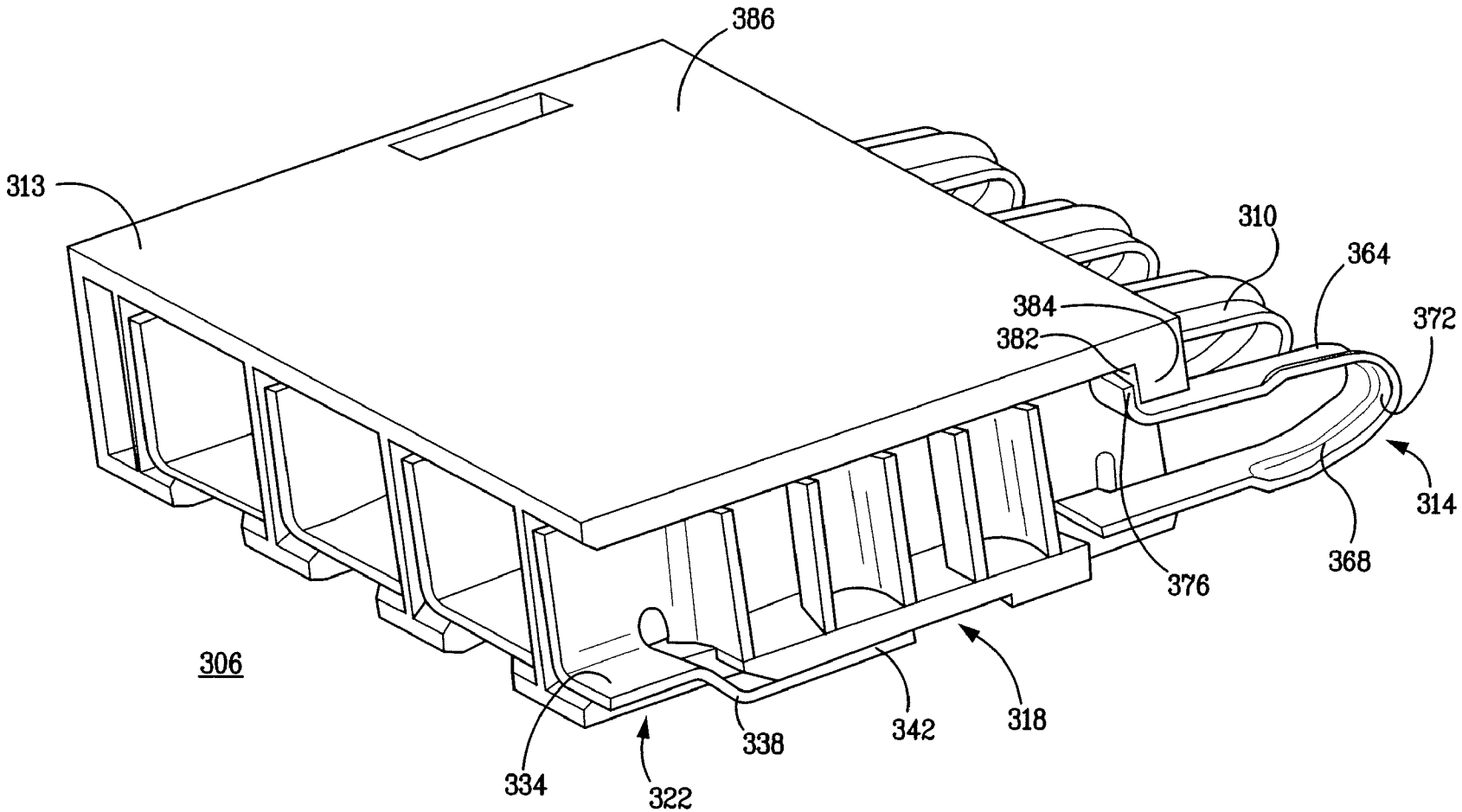
FIG. 5 is a partial cut away view of the connector shown in FIG. 4.

As shown in FIG. 5, each contact may have a nose portion 314, a corrugated portion 318, and a tail portion 322. Each tail portion 322, may include an upper portion 334, a transition portion 338, and a lower portion 342. Each nose portion 314, may include an upper portion 364, a lower portion 368, and an end portion 372. Each upper portion 364 of the nose portion 314 may include a lip 376.

The lip 376 may abut an inside surface 382 of a protrusion 384 when the contact 310 is in a decompressed state. As depicted, the protrusion 384 may extend below a top side 386 of the housing 313. When the end of the contact 310 is pressed on by a battery, the contact 310 may compress within the housing 313.

Figure 4:
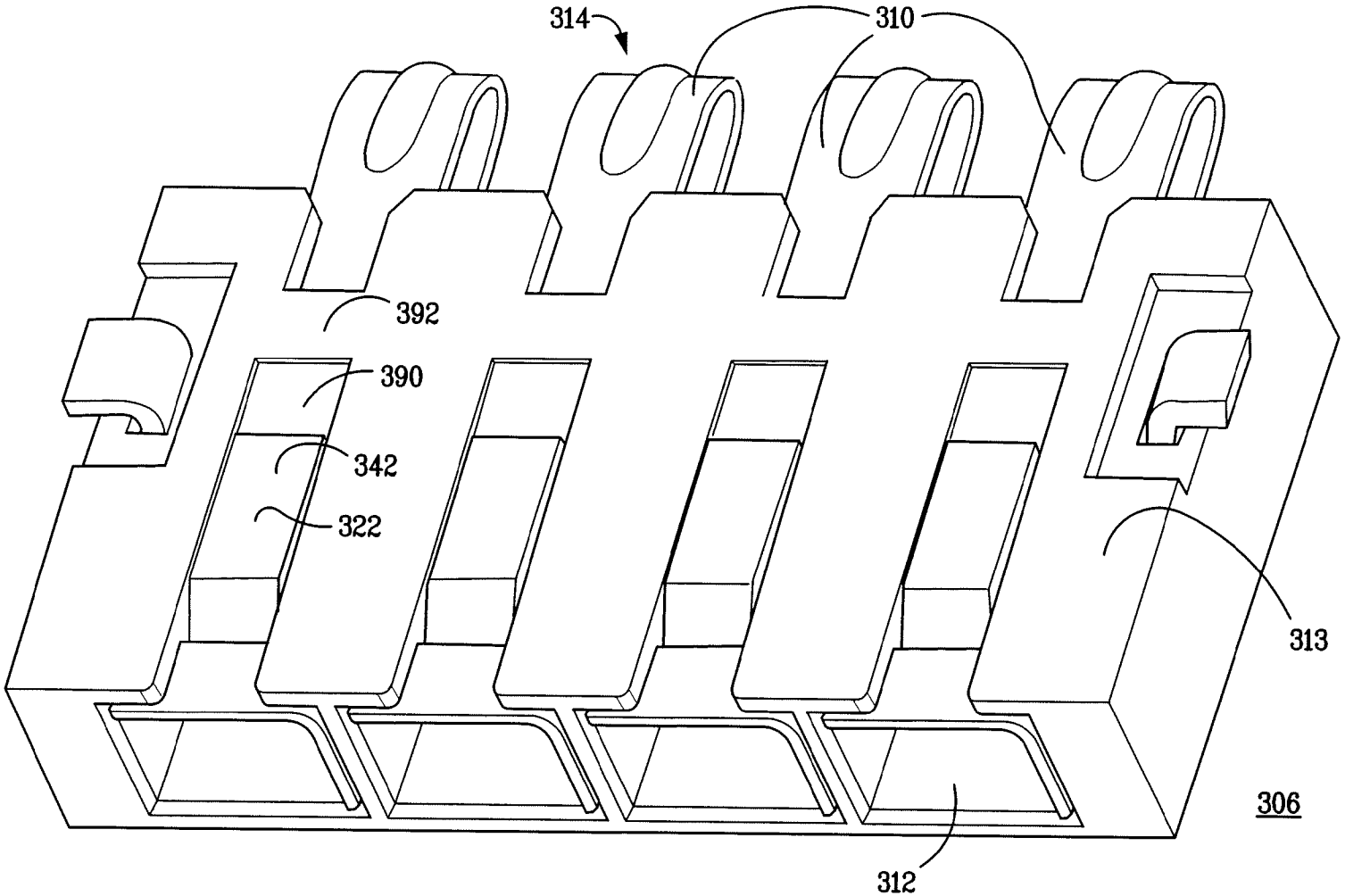
FIG. 4 is a bottom perspective view of an electrical connector.

Each tail portion 322 may provide a mounting surface for its respective contact. As shown in FIG. 4, the lower portion 342 may extend below and abut a recess 390 formed in a bottom surface 392 of the housing 313, thereby mounting the contact 310 to the housing 313. As depicted, the lower portion 342 may extend toward the nose portion 314.

Figure 6A:
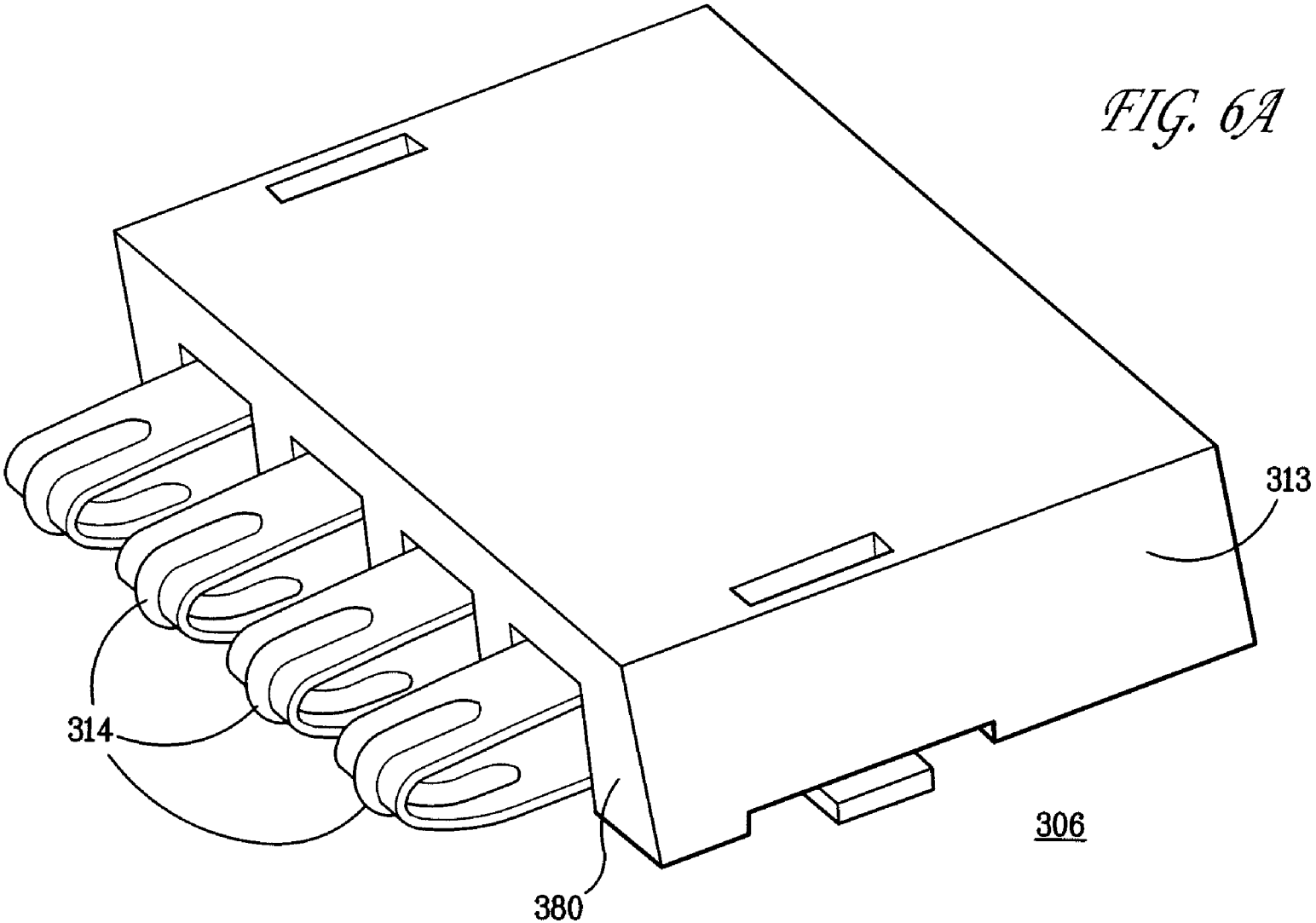
FIGS. 6A and 6B are top perspective views of the connector shown in FIG. 4.
Figure 6B:
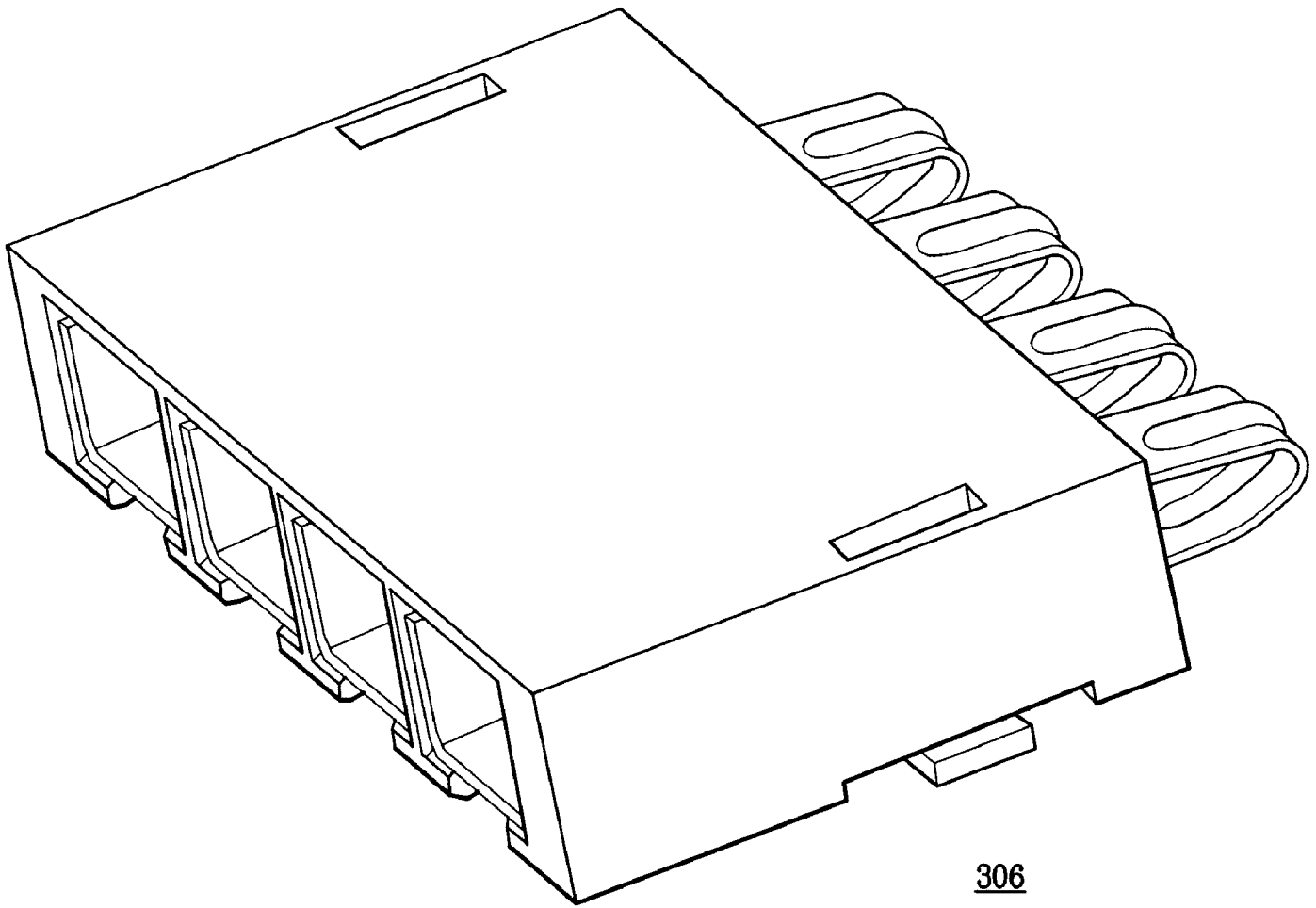

An example of a completed connector 306 is depicted in FIGS. 6A and 6B. As depicted, when the contact is in the decompressed state, the nose portion 314 may protrude from a front side 380 of the housing 313. The connector 306 is not limited to the structures described and shown in the FIGs.

Accordingly, the connector 306 may have other designs, and may incorporate other embodiments of the compressible contacts.

It should be understood that the connector 306 is depicted with contacts 310, though it may include other contacts, such as contacts 10, 110, and the housing may be designed to accommodate the contacts 10, 110. Therefore, the connector housing 313 may have different designs and structures depending on the design of the compressible contacts and the number of contacts used.

What is claimed:

1. A compressible electrical contact comprising:

a corrugated portion defining a first end and a second end opposite the first end;

a tail portion extending from the first end of the corrugated portion; and a nose portion extending from the second end of the corrugated portion;

wherein (i) the electrical contact is stamped from a sheet of electrically-conductive material, the sheet having a thickness, (ii) the corrugated portion defines a first surface and a second surface opposite the first surface, (iii) each of the first and second surfaces has a respective width that is defined by the thickness of the sheet of electrically-conductive material, (iv) the corrugated portion defines a third surface extending between the first and second surfaces, and a fourth surface, opposite the third surface, also extending between the first and second surfaces, (v) each of the third and fourth surfaces has a width that is greater than the widths of the first and second surfaces, and (vi) a plurality of corrugations are formed in the third and fourth surfaces.

2. The electrical contact of claim 1, wherein the tail portion defines a surface mounting end that extends in a direction from the first end of the corrugated portion toward the nose portion.

3. The electrical contact of claim 1, wherein the tail portion defines a surface mounting end that extends in a direction from the first end of the corrugated portion away from the nose portion.

4. The electrical contact of claim 1, wherein (i) the tail portion comprises a first planar portion that defines a first plane and a second planar portion that defines a second plane (ii) the second plane is offset from the first plane, and (iii) the tail portion comprises a transition portion extending between the first and second planar portions.

5. The electrical contact of claim 4, wherein the second planar portion extends from the transition portion in a direction toward the nose portion.

6. The electrical contact of claim 4, wherein the second planar portion extends from the transition portion in a direction away from the nose portion.

7. The electrical contact of claim 2, wherein (i) the tail portion comprises a planar portion that extends from the first end of the corrugated portion, and (ii) the planar portion has a thickness defined by the thickness of the sheet of electrically conductive material.

8. The electrical contact of claim 7, wherein the planar portion of the tail portion is perpendicular to the third surface of the corrugated portion.

9. The electrical contact of claim 1, wherein the nose portion has a distal end that is adapted to engage a battery.

10. The electrical contact of claim 1, wherein (i) the corrugated portion defines a first longitudinal axis, and (ii) the nose portion defines a second longitudinal axis that is offset from the first longitudinal axis.

11. An electrical connector comprising:

a housing that defines an aperture; and a compressible electrical contact disposed in the aperture of the housing, the contact comprising (i) a corrugated portion defining a first end and a second end opposite the first end; (ii) a tail portion extending from the first end of the corrugated portion; and (iv) a nose portion extending from the second end of the corrugated portion, the nose portion having an upper portion and a lower portion separated from the upper portion by a distance;

wherein (i) the corrugated portion defines a first surface and a second surface opposite the first surface, (ii) each of the first and second surfaces has respective opposing outer edges that define a width therebetween, (iii) the corrugated portion defines a third surface extending between the first and second surfaces, and a fourth surface, opposite the third surface, also extending between the first and second surfaces, (iv) each of the third and fourth surfaces has respective opposing outer edges that define a width therebetween, such that the widths of the third and fourth surfaces are greater than the widths of the first and second surfaces, and greater than the distance between the upper and lower portions of the nose, and (v) a plurality of corrugations are formed in the third and fourth surfaces.

12. The electrical connector of claim 11, wherein the electrical contact is stamped from a sheet of electrically-conductive material, the sheet having a thickness, and wherein the widths of the first and second surfaces are defined by the thickness of the sheet.

13. The electrical connector of claim 11, wherein the tail portion of the contact defines a surface mounting end that extends in a direction from the first end of the corrugated portion toward the nose portion.

14. The electrical connector of claim 11, wherein the tail portion of the contact defines a surface mounting end that extends in a direction from the first end of the corrugated portion away from the nose portion.

15. The electrical connector of claim 12, wherein (i) the tail portion of the contact comprises a planar portion that extends from the first end of the corrugated portion, and (ii) the planar portion has a thickness defined by the thickness of the sheet of electrically conductive material.

16. The electrical connector of claim 15, wherein the planar portion of the tail portion is perpendicular to the third surface of the corrugated portion.

17. The electrical connector of claim 11, wherein the nose portion of the contact has a distal end that is adapted to engage a battery.

18. A method for making a compressible electrical contact, the method comprising:

(a) stamping a shaped piece from a sheet of electrically-conductive material having a thickness;

(b) forming a corrugated portion defining a first end and a second end;

(c) forming a tail portion at the first end of the corrugated portion; and (d) forming a nose portion at the second end of the corrugated portion;

wherein (i) the corrugated portion defines a first surface and a second surface opposite the first surface, (ii) each of the first and second surfaces has a respective width that is defined by the thickness of the sheet of electrically-conductive material, (iii) the corrugated portion defines a third surface extending between the first and second surfaces, and a fourth surface, opposite the third surface, also extending between the first and second surfaces, (iv) each of the third and fourth surfaces has a width that is greater than the widths of the first and second surfaces, and (v) a plurality of corrugations are formed in the third and fourth surfaces.

19. The method of claim 18, further forming the tail portion of the contact such that the tail portion comprises (i) a planar portion that extends from the first end of the corrugated portion, and (ii) the planar portion has a thickness defined by the thickness of the sheet of electrically conductive material.

20. The method of claim 19, further forming the corrugated portion such that the planar portion of the tail portion is perpendicular to the third surface of the corrugated portion.

21. A compressible electrical contact comprising:

a corrugated portion defining a first end and a second end opposite the first end;

a tail portion extending from the first end of the corrugated portion; and a nose portion extending from the second end of the corrugated portion, wherein the nose portion has an upper portion and a lower portion spaced from the upper portion with respect to a first direction;

wherein the corrugated portion includes a surface having corrugations that extend along a second direction that is perpendicular to the first direction.

22. A compressible electrical contact comprising:

a corrugated portion defining a first end and a second end opposite the first end;

a tail portion extending from the first end of the corrugated portion; and a nose portion extending from the second end of the corrugated portion;

wherein the corrugated portion defines a first corrugated surface and a second opposing corrugated surface, the first corrugated surface defines a width extending between opposing outer edges of the first corrugated surface, the first and second corrugated surfaces define a thickness along a direction that extends normal to the first and second corrugated surfaces, and the width is greater than the thickness.

23. The compressible electrical contact of claim 22, wherein the outer edges are curved.

24. The compressible electrical contact of claim 21, wherein the first direction is vertical.

25. The compressible electrical contact of claim 21, wherein the upper and lower portions extend substantially parallel to each other.

26. An electrical connector comprising:

a housing that defines an aperture; and a compressible electrical contact disposed in the aperture of the housing, the contact comprising (i) a corrugated portion defining a first end and a second end opposite the first end; (ii) a tail portion extending from the first end of the corrugated portion; and (iv) a nose portion extending from the second end of the corrugated portion, the nose portion having an upper portion and a lower portion separated from the upper portion by a distance;

wherein (i) the corrugated portion defines a first surface and a second surface opposite the first surface, (ii) each of the first and second surfaces has a respective width, (iii) the corrugated portion defines a third surface extending between the first and second surfaces, and a fourth surface, opposite the third surface, also extending between the first and second surfaces, (iv) each of the third and fourth surfaces has a width that is greater than the widths of the first and second surfaces, and greater than the distance between the upper and lower portions of the nose, (v) a plurality of corrugations are formed in the third and fourth surfaces, and the electrical contact is stamped from a sheet of electrically-conductive material, the sheet having a thickness, and the widths of the first and second surfaces are defined by the thickness of the sheet.

* * * * *